US006277548B1

(12) United States Patent
Barber et al.

(10) Patent No.: US 6,277,548 B1
(45) Date of Patent: Aug. 21, 2001

(54) MOTION PICTURE PRINT FILM HAVING IMPROVED LASER SUBTITLING PERFORMANCE

(75) Inventors: Gary N. Barber, Penfield; Christopher J. Haller, Rochester; Mary C. Brick, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/631,917

(22) Filed: Aug. 3, 2000

(51) Int. Cl.[7] ..... G03C 1/005; G03C 1/91; G03C 1/815; G03C 1/83

(52) U.S. Cl. ..... 430/505; 430/22; 430/507; 430/510; 430/527; 430/934

(58) Field of Search ..... 430/22, 505, 507, 430/510, 527, 934

(56) References Cited

U.S. PATENT DOCUMENTS

| | | | | |
|---|---|---|---|---|
| 4,233,392 | | 11/1980 | Friedel . | |
| 4,245,003 | | 1/1981 | Oransky et al. . | |
| 4,272,594 | | 6/1981 | George et al. . | |
| 4,301,239 | | 11/1981 | Miller . | |
| 4,304,833 | * | 12/1981 | Foley | 430/221 |
| 4,477,562 | | 10/1984 | Zeller-Pendrey . | |
| 4,542,087 | * | 9/1985 | Brust | 430/220 |
| 4,548,898 | | 10/1985 | Yamado et al. . | |
| 4,588,674 | | 5/1986 | Stewart et al. . | |
| 4,702,958 | | 10/1987 | Itoh et al. . | |
| 4,711,834 | | 12/1987 | Butters et al. . | |
| 4,741,980 | * | 5/1988 | Kaneko | 430/17 |
| 4,816,363 | * | 3/1989 | Naito et al. | 430/69 |
| 4,854,696 | | 8/1989 | Guez . | |
| 5,104,767 | | 4/1992 | Nakamura . | |
| 5,238,794 | * | 8/1993 | Hirose et al. | 430/496 |
| 5,367,348 | | 11/1994 | Nachmanson et al. . | |
| 5,576,162 | * | 11/1996 | Papadopoulos | 430/527 |
| 5,627,007 | | 5/1997 | Van den Bergh et al. . | |
| 5,679,505 | | 10/1997 | Tingler et al. . | |
| 5,981,155 | | 11/1999 | Vercruysse et al. . | |
| 6,107,015 | * | 8/2000 | Anderson et al. | 430/525 |

FOREIGN PATENT DOCUMENTS

| | | |
|---|---|---|
| 1237552 | 9/1989 | (JP) . |

* cited by examiner

*Primary Examiner*—Janet Baxter
*Assistant Examiner*—Amanda C. Walke
(74) *Attorney, Agent, or Firm*—Andrew J. Anderson

(57) ABSTRACT

A motion picture film photographic element is disclosed comprising a support having on a front side thereof a subbing layer unit and one or more image-forming units comprising at least one light-sensitive silver halide emulsion layer coated over the subbing layer unit, wherein the layers coated on the front side of the support comprise in total from 5 to 30 mg/m$^2$ of dispersed carbon particles, and the majority of the dispersed carbon particles is contained in the emulsion layer or layers of the one or more image forming units or in intercoat layers which may be present between two emulsion layers. The motion picture photographic film clement provides improved performance when marked by means of a laser beam.

20 Claims, No Drawings

MOTION PICTURE PRINT FILM HAVING IMPROVED LASER SUBTITLING PERFORMANCE

FIELD OF THE INVENTION

The present invention relates in general to photography and in particular to a novel photographic motion picture print film element. More specifically, this invention relates to a motion picture print film having finely dispersed carbon particles incorporated therein, which print film is capable of being marked with a laser with improved performance.

BACKGROUND OF THE INVENTION

Marking of photographic film elements to provide, e.g., graphic elements, characters, bar codes or text is often desired in the photographic art. The showing of foreign language films in a motion picture theater, e.g., typically includes the simultaneous display of the translated dialogue in the form of marked subtitles. A current frequently used method of subtitle marking, described in U.S. Pat. Nos. 4,854,696 and 5,367,348, involves embossing or etching the subtitle text into the film's photographic emulsion image layer(s).

Marking is currently frequently done by laser ablation, wherein a laser beam of high energy travels along a determined path corresponding to the inscriptions to be formed on the film clement. In such method, the silver halide photographic emulsion present in the layer(s) coated onto the film support becomes ablated locally. Photographic color films comprise image dye-forming emulsion layers coated on a transparent support, and the marked or ablated areas comprise clear or low density areas surrounded by the unmarked dye-containing image areas. Similarly, for black and white films the marked or ablated areas comprise clear or low density areas surrounded by the unmarked image areas which contain silver metal. In the particular application of laser subtitling of photographic films, the quality of laser marked subtitles is dependent upon the density and color differences between the marks and the surrounding dye or silver image areas, and on the wavelength, power, and writing speed of the laser. The power and speed are selected to remove as much of image emulsion layers as possible without damaging or distorting the support. Laser subtitling is typically performed on the final color or black and white release print film intended for projection in a theater, but may also be performed on color intermediate or black and white films to form subtitle images which may then be optically printed onto another intermediate or black and white film to form a negative image, which may then be printed onto the final release print film.

Most laser subtitling systems were originally designed and optimized for marking motion picture films having acetate film base supports. A switch in the industry from acetate to polyester supports for motion picture print films has required the subtitlers to make changes in their operations to reoptimize results, which has been a problem as thermoplastic polymer support materials, such as polyester, are more succeptible to support damage. There is an inherent conflict between using sufficient power to mark in low density image areas without causing significant base damage in the high density image areas, as due to the non-uniform release of gelatinous residues or to the damage of the support, undesired dark and/or colored spots may be observed when the film image is enlarged and projected on the screen in a theater, especially for print films having polyester film supports.

SUMMARY OF THE INVENTION

It is an aim of the present invention to provide motion picture photographic film elements which provide improved performance when marked by means of a laser beam.

In accordance with the present invention there is provided a motion picture photographic film element comprising a support having on a front side thereof a subbing layer unit and one or more image-forming units comprising at least one light-sensitive silver halide emulsion layer coated over the subbing layer unit, wherein the layers coated on the front side of the support comprise in total from 5 to 30 mg/m$^2$ of dispersed carbon particles, and the majority of the dispersed carbon particles is contained in the emulsion layer or layers of the one or more image forming units or in intercoat layers which may be present between two emulsion layers.

In accordance with the preferred embodiment, there is provided a color motion picture print or intermediate film element comprising a support having on a front side thereof a subbing layer unit and yellow, magenta, and cyan dye image-forming units comprising light-sensitive silver halide emulsion layers coated over the subbing layer unit, wherein the layers coated on the front side of the support comprise in total from 5 to 30 mg/m$^2$ of dispersed carbon particles, and the majority of the dispersed carbon particles is contained in the emulsion layers of the yellow, magenta, and cyan dye image-forming units or in intercoat layers which may be present between two emulsion layers.

In accordance with a specific preferred embodiment of the present invention there is provided a color motion picture print film element comprising a support having on a front side thereof, in order, a yellow dye image-forming unit comprising at least one blue-sensitive silver halide emulsion layer having associated therewith at least one yellow dye-forming coupler, a first emulsion intercoat layer, a cyan dye image-forming unit comprising at least one red-sensitive silver halide emulsion layer having associated therewith at least one cyan dye-forming coupler, a second emulsion intercoat layer, and a magenta dye image-forming unit comprising at least one green-sensitive silver halide emulsion layer having associated therewith at least one magenta dye-forming coupler, wherein the layers coated on the front side of the support comprise in total from 5 to 30 mg/m$^2$ of dispersed carbon particles, and the majority of the dispersed carbon particles is contained in the emulsion layers and emulsion intercoat layers.

DETAILED DESCRIPTION OF THE INVENTION

Motion picture film photographic elements of the invention comprise a support having on a front side thereof a subbing layer unit and at least one silver halide emulsion layer. In preferred embodiments, the elements of the invention may include an antihalation undercoat in the subbing layer unit between the support and the silver halide emulsion layer(s), an outermost protective overcoat layer, an antistatic layer on either side of the support, and an outermost protective backcoat layer on the back side of the support.

The materials employed as the support member are synthetic high molecular weight polymeric materials. These materials may be comprised of various polymeric films, but polyester and cellulose triacetate film supports, which are well known in the art, are preferred. The advantages of the invention are particularly applicable when thermoplastic polymer supports, particularly polyester film supports such as poly(ethylene terephthalate), are used. For acetate supports, the use of dispersed carbon particles in accordance with the invention may advantageously allow good subtitling results to be obtained with lower power settings than previously required. The thickness of the support is not critical. Conventional support member thicknesses of from about 50 to 250 microns (2 to 10 mils, or 0.002 to 0.010 inches) can be employed, for example, with very satisfactory results.

The term "subbing layer unit" as used herein applies to layers of the photographic element coated between the support and the photographic emulsion layer closest to the support. Subbing layers coated between a support and the photographic imaging emulsion layers of a photographic element are conventionally employed in the art to provide improved adhesion of the imaging layers to the support, as well as other functionality such as antihalation or antistatic protection. As described in U.S. Pat. No. 4,132,552, e.g., it is often useful to employ a combination in the subbing layer unit of at least one hydrophobic "primer" layer directly contacting the film support and at least one hydrophilic layer coated thereupon. Polyester support members, e.g., typically employ a primer layer between the functional layers and the polyester support. Such primer layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178 and 3,501,301. Additional polymers useful as primer layers in a subbing layer unit include styrene-butadiene copolymers, water-soluble polyesters and polyacrylic esters.

The hydrophilic layer which may be coated adjacent to the primer layer in a subbing layer unit preferably comprises a hydrophilic colloid to provide good adhesion to hydrophilic colloid layers coated thereover, and may also include an aqueous latex dispersion, optionally containing a cross-linking agent, a swelling agent, a matting agent or an antistatic agent. Hydrophilic colloids such as dextran, polyacrylamide, polyvinylalcohol and polyvinyl pyrrolidone may be used, but particularly preferred is gelatin, optionally in combination with at least one of the other hydrophilic colloids cited. Preferably hydrophilic layers are gelatinous layers. The gelatin used therein can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Gelatin derivatives may be useful. Said derivatives have e.g. been described in U.S. Pat. Nos. 4,978,607; 5,378,598; 5,395,748 and 5,439,791 and in EP-A's 0 628 860 and 0 666 498. Examples of the cross-linking (or hardening) agent include triazine compounds as described e.g. in U.S. Pat. Nos. 3,325,287; 3,288,775 and 3,549,377; dialdehyde compounds as described in U.S. Pat. Nos. 3,291,624 and 3,232,764; epoxy compounds as described in U.S. Pat. No. 3,091,537; vinyl compounds described in U.S. Pat. No. 3,642,486; aziride compounds described in U.S. Pat. No. 3,392,024; ethyleneimine compounds described in U.S. Pat. No. 3,549,378 and methylol compounds. Combinations of vinyl sulphonyl compounds and triazine compounds may be useful and particularly the combination set forth in U.S. Pat. No. 4,680,257.

In accordance with the invention, one or more image-forming units comprising at least one light-sensitive silver halide emulsion layer is coated over the subbing layer unit. The invention is applicable to color photographic print and intermediate film elements as well as black and white motion picture photographic film elements. While a single silver halide emulsion layer may typically be used in a black and white film element, a color photographic print or intermediate element in accordance with preferred embodiments of this invention will typically contain dye image-forming units sensitive to each of the three primary regions of the spectrum, in the form of a blue-sensitive layer having a yellow color coupler associated therewith, a green-sensitive layer having a magenta color coupler associated therewith, and a red-sensitive layer having a cyan color coupler associated therewith (i.e., separate yellow, magenta, and cyan dye image-forming units). Each unit may be comprised of a single light-sensitive layer, a pack of two light-sensitive layers with one being more light sensitive and the other being less light-sensitive, or a pack of three or more light-sensitive layers of varying light-sensitivity. The layers of the element, including the layers of the image-forming units, can be arranged in various orders as is well known in the art.

A multicolor photographic print film element in accordance with preferred embodiments of the invention comprises a support bearing, in order, a yellow dye image-forming unit comprising at least one blue-sensitive silver halide emulsion layer having associated therewith at least one yellow dye-forming coupler, a first emulsion intercoat layer, a cyan dye image-forming unit comprised of at least one red-sensitive silver halide emulsion layer having associated therewith at least one cyan dye-forming coupler, a second emulsion intercoat layer, and a magenta dye image-forming unit comprising at least one green-sensitive silver halide emulsion layer having associated therewith at least one magenta dye-forming coupler.

The silver halide emulsion layers of dye-image forming units and the emulsion intercoat layers will comprise a hydrophilic binder, typically gelatin. The intercoat layers positioned between adjacent dye image-forming units of photographic elements function to separate and prevent image spread between the adjacent image-forming units.

In accordance with the invention, the layers coated on the emulsion side of the support comprise in total from 5 to 30 $mg/m^2$ of dispersed carbon particles, preferably at least 6 $mg/m^2$, and preferably at most 22 $mg/m^2$ and most preferably at most 20 $mg/m^2$, where the majority of the dispersed carbon particles is contained in the emulsion layers and emulsion intercoat layers. Carbon particles are efficient light absorbers, and it is believed that they absorb the incident laser energy during laser marking, resulting in localized "hot spots" which facilitate ablation and removal of the surrounding gelatin matrix. If total coverages of below 5 $mg/m^2$ are employed, little impact on laser subtitling performance will typically be demonstrated. If coverages of above 30 $mg/m^2$ are employed, while ablation is facilitated, the high carbon coverages result in higher than desired minimum densities in the film image (e.g., higher than 0.2 density). To obtain preferred minimum densities of less than or equal to 0.15, total dispersed carbon coverages of at most 22 $mg/M^2$ are preferred, and to enable more preferred minimum densities of less than or equal to 0.12, coverages of at most 20 $mg/m^2$ are more preferred. Also, the higher coverages can adversely impact heat stability of the film during projection of the image, due to absorption of the radiant energy from the projector lamp by the carbon particles.

While additional layers of the photographic elements of the invention which are coated under or over all the emulsion emulsion layers may comprise some dispersed carbon particles, the majority of the dispersed carbon particles must be located in the emulsion layers or intercoat layers in accordance with the invention. Further, photographic films in accordance with the invention preferably comprise less than 5 mg/m$^2$ of dispersed carbon particles in layers within 1 micrometer of the support surface, and also preferably comprise less than 5 mg/m$^2$ of dispersed carbon particles in layers coated over all the emulsion layers. Positioning significant levels of carbon particles too close to the support can result in increased support damage upon laser subtitling, and light absorption by significant levels of carbon particles coated over the emulsion layers can lead to undesired photographic speed losses.

Where the print films in accordance with preferred embodiments of the invention comprise yellow, cyan and magenta dye image-forming units coated in order from the support, the majority of the dispersed carbon particles are preferably incorporated into the cyan dye image-forming unit or adjacent interlayers in order to optimize laser subtitling performance while minimizing any adverse impact with respect to support damage, heat stability upon projection, and speed loss.

Carbon particles incorporated in photographic elements in accordance with the invention preferably have average dispersed particle sizes of less than 0.3 microns in order to facilitate incorporation thereof into photographic element layers without adverse impact upon manufacturing and photographic performance of the element, more preferably less than 0.22 microns and most preferably less than 0.16 microns. Commercially available carbon samples (e.g., Black Pearls 280, Black Pearls 430, Black Pearls 490, Black Pearls 700, Black Pearls 880, Black Pearls 1000, Regal 250, Regal 350, and Regal 400 available from Cabot Corp.) may be obtained and milled in accordance with conventional procedures (e.g., in accordance with the milling process described in U.S. Pat. No. 5,500,331 ) to obtain desired dispersed particle size.

The light-sensitive silver halide emulsions employed in the emulsion layers of the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. Photographic print films typically use relatively small grain, high chloride emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use. The emulsions typically will be gelatin emulsions although other hydrophilic colloids can be used in accordance with usual practice. The compositions of typical light sensitive image recording layers used in print films are well known, and are not critical to the invention, as any of the silver halide materials used in conventional motion picture films may be used, such as those described, e.g., in *Research Disclosure,* Item 36544, September, 1994, and the references listed therein.

Dye-image-providing materials can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the clement, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivaloylacetanilides.

In accordance with a preferred embodiment of this invention, an antihalation undercoat layer is present as part of the subbing layer unit between the support and the emulsion layers, and is used to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat. The antihalation undercoat layer, when present, preferably does not contain significant quantities of the dispersed carbon particles employed in the print films of the invention (i.e., preferably contains less than 5 mg/m$^2$ dispersed carbon), as discussed above for layers within 1 micrometer of the support.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045,229. Useful mordants are described, for example, in U.S. Pat. Nos. 3,282,699; 3,455,693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes arc generally of the formula:

$D—(X)_n$ where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$[D—(A)_y]—X_n$ where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred examples of solid particle filter dyes include the following:

D-1

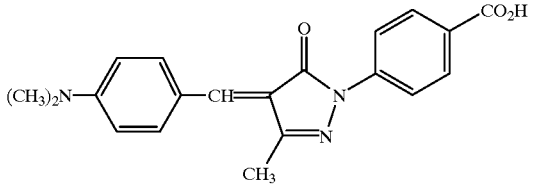

D-2

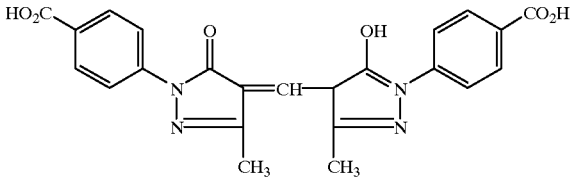

-continued

D-3

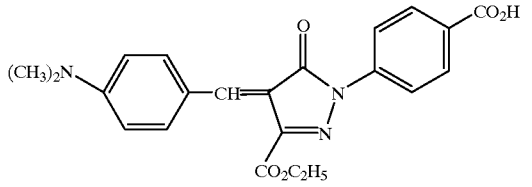

D-4

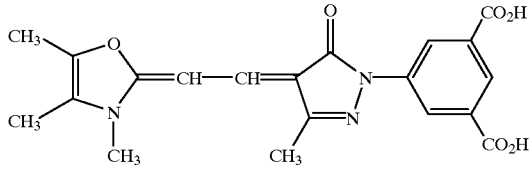

D-5

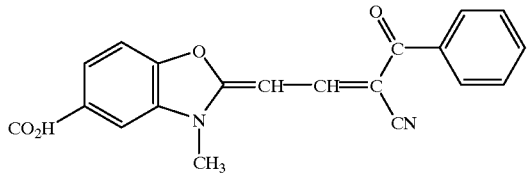

D-6

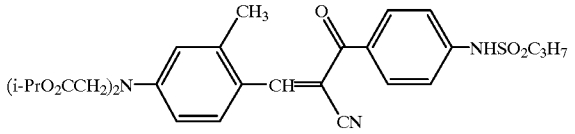

D-7

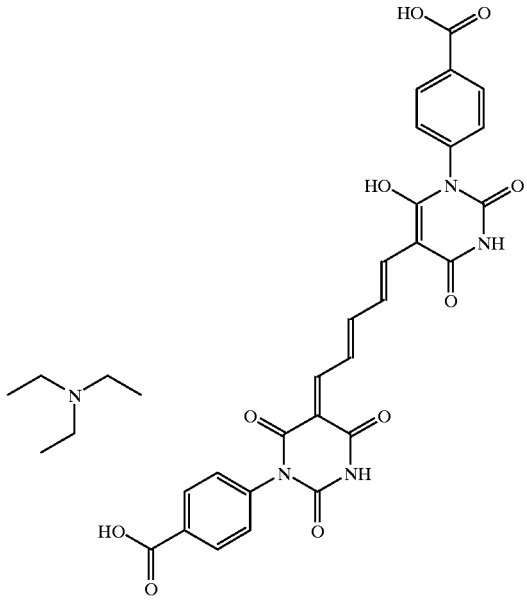

To promote adhesion of the antihalation undercoat to the support, primer layers as hereinabove described are advantageously employed, especially when the support is a polyester support.

The motion picture film elements of the present invention can contain additional auxiliary layers conventional in photographic elements, such as spacer layers, filter layers, pH lowering layers (sometimes referred to as acid layers and neutralizing layers), magnetic recording layers, timing layers, barrier layers, antistatic layers, and outermost protective overcoat and backcoat layers.

The photographic silver halide film elements in accordance with the invention can contain addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

To further improve laser subtitling performance or other print film properties, it is specifically contemplated that print films in accordance with the invention may incorporate anti-oxidant and UV absorbers as described in U.S. Pat. No. 5,981,155, the disclosure of which is incorporated by reference. Antioxidants in particular may be useful in lessening adverse impact of carbon particles on heat stability upon projection of print films containing such carbon particles.

Outermost protective overcoat and the outermost protective backcoat layers typically comprise film-forming binder and matting agent. The film-forming binder can be essentially any known polymeric binder. This includes hydrophilic colloids such as gelatin as well as hydrophobic polymers. Particularly preferred polymeric binders for use in the backcoat include aliphatic polyurethanes such as those described in U.S. Pat. No. 5,679,505 which is incorporated herein by reference.

In a particularly preferred embodiment the motion picture films of the invention include an antistatic layer whose antistatic properties survive film processing. The antistatic layers may include a variety of electrically conductive metal-containing particles, such as metal oxides, dispersed in a binder material. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445 and 5,368,995. Other useful electrically conductive materials for use in antistatic layers include:

Semiconductive metal salts such as cuprous iodide as described in U.S. Pat. Nos. 3,245,833; 3,428,451 and 5,075,171.

Fibrous conductive powders comprising, for example, antimony-doped tin oxide coated onto non-conductive potassium titanate whiskers as described in U.S. Pat. Nos. 4,845,369 and 5,116,666.

Conductive polymers, such as, the cross-linked vinylbenzyl quaternary ammonium polymers of U.S. Pat. Nos. 4,070,189, the conductive polyanilines of U.S. Pat. No. 4,237,194, and conductive polythiophenes of U.S. Pat. Nos. 4,987,042; 5,035,926; 5,354,613; 5,370,981; 5,372,924; 5,543,944 and 5,766,515.

A colloidal gel of vanadium pentoxide or silver-doped vanadium pentoxide as described in U.S. Pat. Nos. 4,203,769; 5,006,451; 5,221,598 and 5,284,714.

Typically, the antistatic layer is coated at a dry coverage of from 1 to 1000 mg/m$^2$ based on total dry weight. The electrical resistivity of the antistatic layer is preferably from about 7 to about 11 log Ω/□, more preferably from about 8 to 11 log Ω/□, and most preferably from about 8.5 to 10 log Ω/□.

The antistatic layer may be present on either side or both sides of the support material. The antistatic layer may be an internal layer that underlies the antihalation undercoat, protective overcoat, protective backcoat or the emulsion layers. Alternatively, the antistatic layer may be an outermost layer in which the electrically conductive material is included in the protective overcoat or protective backcoat.

The following examples are intended to illustrate the present invention but not to limit it in scope in any way.

EXAMPLE 1

Print film Element A was prepared as follows:

Support and Backing

A subbed polyester support was prepared by first applying a vinylidene chloride copolymer subbing layer to both sides of a support before orientation. An antistatic coating containing vanadium pentoxide and vinylidene chloride copolymer was applied onto one side of the support. Finally a protective layer containing Sancure 898 polyurethane binder, coating surfactants, wax lubricant and polymethylmethacrylate matte beads was applied over the antistatic layer.

A conventional thin gelatin subbing layer (gelatin coverage approximately 75 mg/m$^2$) was applied onto the vinylidene chloride copolymer subbing layer on the side of the support opposite to the antistatic layer and backcoat.

Front Sensitized Coating

Layer 1—Antihalation Layer

An antihalation undercoat having the following composition was applied onto the gelatin subbing layer:

| | |
|---|---|
| Gelatin | 759 mg/m$^2$ |
| Solid Particle Antihalation Filter Dye (AFD-1) | 56.5 mg/m$^2$ |
| Solid Particle Antihalation Filter Dye (AFD-2) | 129 mg/m$^2$ |
| Poly(acrylamide-co-2-acrylamido-2-methylpropane sodium sulfonate) | 24.8 mg/m$^2$ |
| Gelatin hardener | |
| Coating surfactant | |

Layer 2—Blue Sensitive Layer

Above the antihalation layer was a yellow dye-forming layer comprising a blue-sensitized silver halide emulsion, a yellow dye-forming coupler, and additional materials as follows:

| | |
|---|---|
| Gelatin | 2475 mg/m$^2$ |
| AgCl blue-sensitized emulsion | 775 mg/m$^2$ |
| Yellow dye-forming coupler (Y-1) | 1291 mg/m$^2$ |
| Ultraviolet absorber compound (UV-1) | 215 mg/m$^2$ |
| Yellow preformed dye (YPD-1) | 10.7 mg/m$^2$ |
| Soluble blue filter dye (BFD-1) | 32.2 mg/m$^2$ |

Layer 3—Blue/Red Separation Intercoat Layer

Above the yellow dye-forming layer was a blue/red separation intercoat layer that prevents image spread between the yellow dye-forming layer and the cyan dye-forming layer. The composition of the blue/red separation layer was as follows:

| | |
|---|---|
| Gelatin | 610 mg/m$^2$ |
| Oxidized developer scavenger (Scav-1) | 86.1 mg/m$^2$ |
| Antifoggant compound (AF-1) | 2.7 mg/m$^2$ |
| Coating Surfactants | |

Layer 4—Red Sensitive Layer

Above the blue/red separation layer was a cyan dye-forming layer comprising a red-sensitized silver halide emulsion, a cyan dye-forming coupler, and additional materials as follows:

| | |
|---|---|
| Gelatin | 3120 mg/m$^2$ |
| AgCl red-sensitized emulsion | 458 mg/m$^2$ |
| Cyan dye-forming coupler (C-1) | 861 mg/m$^2$ |
| Dibutyl sebacate | 517 mg/m$^2$ |
| Phenylethyl benzoate | 517 mg/m$^2$ |
| Oxidized developer scavenger (Scav-1) | 5.0 mg/m$^2$ |
| PINA ™ Filter Bluegreen dye (Riedel deHaen Company) | 75.3 mg/m$^2$ |
| Antifoggant compound (AF-2) | 4.3 mg/m$^2$ |

Layer 5—Red/Green Separation Intercoat Layer

Above the cyan dye-forming layer was a red/green separation intercoat layer that prevents image spread between the cyan dye-forming layer and the magenta dye-forming layer. The composition of the red/green separation intercoat layer was identical to the composition of the blue/red separation intercoat layer.

Layer 6—Green Sensitive Layer

Above the red/green separation intercoat layer was a magenta dye-forming layer comprising a green-sensitized silver halide emulsion, a magenta dye-forming coupler, and additional materials as follows:

| | |
|---|---|
| Gelatin | 1507 mg/m$^2$ |
| AgCl green-sensitized emulsion | 495 mg/m$^2$ |
| Magenta dye-forming coupler (M-1) | 700 mg/m$^2$ |
| Tricresyl phosphate | 140 mg/m$^2$ |
| Oxidized Developer Scavenger (Scav-1) | 10.8 mg/m$^2$ |
| Soluble green filter dye (GFD-1) | 26.9 mg/m$^2$ |
| Soluble green filter dye (GFD-2) | 32.3 mg/m$^2$ |

Layer 7—Protective Overcoat

A protective overcoat having the following composition was applied over the green sensitive layer:

| | |
|---|---|
| Gelatin | 976 mg/m$^2$ |
| Polydimethylsiloxane lubricant (Dow Corning) | 16.1 mg/m$^2$ |
| Polymethylmethacrylate matte beads, avg. size = 1.5 $\mu$m | 16.1 mg/m$^2$ |
| Fluorosurfactant FT-248 (Bayer) | 5.4 mg/m$^2$ |
| Coating surfactant | |

Elements B through M were prepared in a manner similar to Element A except that finely dispersed carbon particles were added to one or more layers. The finely dispersed carbon particles were prepared by using a milling process similarly as described in U.S. Pat. No. 5,500,331. An aqueous mixture of Black Pearls 880 (Cabot Corp.) was milled in a conventional media mill with 50 micron polymeric beads to a median particle size of 70 nm (0.07 microns). The carbon level and the layer(s) in which the carbon was incorporated are shown in Table 1. Element E' also contained an antioxidant compound (A-1), at a level and layer placement indicated in Table 1.

Testing

Elements A through M were evaluated with a number of tests. In all cases, the film was exposed and processed through a typical motion picture color print process (Kodak ECP-2B standard process).

The film elements as described above were tested for laser subtitling performance, light and heat damage resistance in a motion picture projector, benchtop light and heat damage resistance, and sensitometric performance, particularly with respect to the area of lowest light intensity exposure where the minimum density (D-min) is formed.

Laser subtitling performance was evaluated on film that was exposed and processed to yield areas with both low density (~0.3 optical density) and high density (>2.5 optical density) patches. The film was then laser ablated with an Argon laser in a manner similar to that described in U.S. Pat. No. 5,367,348 to burn text images into both the low density and high density areas of the film. A scan rate and power setting was employed to generate an energy density at the film plane that is equivalent to that used in the trade. The representative text was a typical aspect ratio used for laser subtitling for motion picture projection. After the ablation process, the film was washed to remove debris created during the laser ablation process as recommended in U.S. Pat. No. 5,367,348. The treated samples were then projected in a small projection theater and qualitatively and comparatively rated from 1 to 5, with a 1 rating indicating that the letters were wide and clean, and a 5 rating indicating that the letters were very narrow, noisy, and difficult to read. In addition to the visual rating evaluation, the samples were evaluated for support damage. Emulsion and subbing layers on the front side of the film was first removed with Clorox™ bleach. Damage to the polyester support was then assessed by visually evaluating a magnified image of the damage. A scale of 1 to 5 was used, with a 1 rating indicating no damage to the support, and a 5 rating indicating severe damage to the support. The results from this test are tabulated in Table 1.

Two tests were used to measure the thermal stability of film samples to a high intensity light source that is placed in close proximity to the film. In a radiant energy test, film samples were first exposed to a black and white image and then processed to generate a black and white image on the film. Loops of film, not treated with any post-processing solution nor edge waxed for projection, were run through a Century projector, which houses a 4000-watt Xenon Lamp, at 6 frames per second for 100 passes with the projector's heat-absorbing filter removed. The 100 passes condition simulates the average number of projections given to typical movie releases, while the 6 frames per second condition simulates exposure to higher wattage bulbs used in some theater projectors. Since the normal operating conditions of projectors are 24 frames per second with the heat-absorbing filter in place, the testing conditions represent an accelerated test. Films were comparatively evaluated for blistering, charring, and physical integrity. The results from this radiant energy test are summarized in Table 1, with a rating of 1 indicating no damage, 2 indicating center blistering, 3 indicating center blistering with light charring outside center, 4 indicating center blistering with moderate charring outside center, and 5 indicating blistering with significant charring and loss of physical integrity.

A second test was used to measure the thermal stability of the film samples. A 100-watt, 12-volt illuminator for a laboratory microscope, which had its heat-absorbing filter removed, was placed in close proximity to a film sample that had been previously exposed and processed to yield an optical density of 0.3. The film sample was subjected to light of fixed intensity for 5 minutes. A fixed light intensity was achieved by first measuring the illuminator light with a photoelectric cell and making compensating voltage adjustments to the illuminator. The heat-damaged areas were photomicrographed, and the resulting images were qualitatively and comparatively evaluated using a rating scale of 1 to 5. A 1 rating indicated that the film showed only a slight brown discoloration, and a 5 rating indicated that the film showed evidence of significant charring and burning. The microscope heat resistance ratings are shown in Table 1.

The film elements were also evaluated for minimum density (D-min), an important photographic characteristic that relates to the highlight areas of projected motion picture print images and that also impacts sound quality. The elements were exposed through a 21-step 0–3 neutral density tablet, processed, and then read with a representative densitometer. The red D-min values are reported in Table 1. Only the red D-min values are included—similar results were seen with the green and blue D-min values. Preferred red D-min values are in the range of 0.05 to 0.15 optical density, more preferably 0.5 to 0.12 optical density.

TABLE 1

| Element Sample | Carbon Level (mg/m$^2$) | Carbon Placement Layer | Laser Subtitling Rating | Subtitling Support Damage | Radiant Energy Resistance | Microscope Heat Resistance Rating | Red D-min |
|---|---|---|---|---|---|---|---|
| A (Comp) | 0 | — | 4 | 3 | 2 | 1 | 0.05 |
| B (Comp) | 10.7 | Layer 1 | 4 | 4 | *NT | NT | 0.10 |
| C (Inv) | 10.7 | Layer 2 | 3 | 4 | 3 | NT | 0.10 |
| D (Inv) | 10.7 | Layer 3 | 2 | NT | 3 | 4 | 0.10 |
| E (Inv) | 5.4 | Layer 4 | 3 | 3 | 3 | 2 | 0.07 |
| **E' (Inv) | 5.4 | Layer 4 | 3 | 2 | 3 | 2 | 0.07 |
| F (Inv) | 6.4 | Layer 4 | 2 | NT | 3 | 2 | 0.08 |
| G (Inv) | 10.7 | Layer 4 | 2 | 3 | 3 | 4 | 0.10 |
| H (Inv) | 17.2 | Layer 4 | 2 | NT | 4 | NT | 0.12 |
| I (Inv) | 21.5 | Layer 4 | 1 | 2 | NT | NT | 0.15 |
| J (Inv) | 10.7 | Layer 5 | 2 | NT | 3 | 4 | 0.10 |
| K (Inv) | 10.7 | Layer 6 | 2 | 2 | NT | NT | 0.10 |
| L (Inv) | 5.35<br>5.35 | Layer 3<br>Layer 5 | 2 | NT | 3 | 4 | 0.10 |
| M (Comp) | 13.5 | Gelatin Subbing Layer | 5 | 5 | NT | NT | 0.11 |

*NT: Not Tested
**Element E' also had 280 mg/m$^2$ of antioxident (A-1) added to Layer 1

The results presented in Table 1 show that Elements D and F through L have significantly improved laser subtitling performance. Many of these examples have excellent laser subtitling performance but may have marginal performance in the projector heat simulations tests or have high D-min values (Element I). Several elements have measurable laser subtitling performance improvements (Elements C, E and E') and acceptable projector heat simulation results and would represent the lower boundaries for layer position (Element C) and carbon levels (Element E and E'). Element E' employing antioxident A-1 in addition to dispersed carbon particles demonstrated equivalent laser subtitling performance as Element E, decreased support damage and slightly improved radiant energy and heat resistance. The comparative Elements A, B and M did not improve laser subtitling and also gave poorer performance in one of the other tests.

EXAMPLE 2

A cyan monochrome coating was prepared with the following structure (Element N):

Support: a support identical to the one described in Example 1 was used.

| | |
|---|---|
| Antihalation Layer: | |
| Gelatin | 1076 mg/m$^2$ |
| Solid Particle Antihalation Filter Dye (AFD-2) | 135 mg/m$^2$ |
| Coating surfactant | |
| Red Sensitive Layer: | |
| Gelatin | 3412 mg/m$^2$ |
| AgCl red-sensitized emulsion | 446 mg/m$^2$ |
| Cyan dye-forming coupler (C-1) | 861 mg/m$^2$ |
| Dibutyl sebacate | 517 mg/m$^2$ |
| Phenylethyl benzoate | 517 mg/m$^2$ |
| Antifoggant compound (AF-2) | 4.3 mg/m$^2$ |
| Coating surfactants | |
| Protective Overcoat: | |
| Gelatin | 977 mg/m$^2$ |
| Polydimethylsiloxane lubricant (Dow Coming) | 65.9 mg/m$^2$ |
| Polymethylmethacrylate matte beads, avg. size = 1.5 $\mu$m | 5.0 mg/m$^2$ |
| PINA ™ Filter Bluegreen dye (Riedel deHaen Company) | 80.7 mg/m$^2$ |

-continued

| | |
|---|---|
| Coating surfactants | |
| Gelatin hardener | |

Elements O through W were prepared in a manner identical to Element N except that in each red-sensitive layer, a different carbon dispersion containing finely dispersed carbon particles was coated at a level of 10.7 mg/n$^2$. The different carbon dispersions were prepared from various carbon types from Cabot Corp. in a manner similar to that described in Example 1. The different carbon types and the median particle sizes of the finely dispersed carbon particles are shown in Table 3. A cyan monochrome format was chosen as the test vehicle to demonstrate the enhanced laser ablation with finely dispersed carbon particles because typical cyan dyes formed in conventional color print materials have little absorbance at 488 and 514 nm where Argon lasers emit.

Elements N through W were exposed through an 11-step 0–3 neutral density tablet and processed in Process ECP-2B with the exception that those steps specific to sound track development were omitted. An area on each of the film elements with an optical red density of ~0.4 was laser ablated and washed as described in Example 1. The laser marked areas of the samples were microtome cross-sectioned to make cross-sections, which were viewed with a microscope so that the individual layers could be seen. 500x photomicrographs were taken of the cross-sectioned images by using a camera attached to the microscope. The photomicrographs were qualitatively rated with a rating scale of 1 to 5; a 1 rating was assigned if laser marking completely removed the protective overcoat and red-sensitive layer, and the sides of the marking were square; a 5 rating was assigned if laser marking hardly removed any of the protective overcoat and red-sensitive layer. The laser marking ratings are shown in Table 2.

TABLE 2

| Sample | Carbon Name | Carbon Particle Size (microns) | Laser Marking Rating |
|---|---|---|---|
| Element N (Comparative) | None | N/A | 5 |
| Element O (Invention) | Black Pearls 880 | 0.071 | 1 |
| Element P (Invention) | Black Pearls 280 | 0.205 | 2 |
| Element Q (Invention) | Black Pearls 43O | 0.113 | 1 |
| Element R (Invention) | Black Pearls 490 | 0.149 | 1 |
| Element S (Invention) | Black Pearls 700 | 0.076 | 1 |
| Element T (Invention) | Black Pearls 1000 | 0.159 | 1 |
| Element U (Invention) | Regal 250 | 0.128 | 1 |
| Element V (Invention) | Regal 350 | 0.219 | 2 |
| Element W (Invention) | Regal 400 | 0.142 | 1 |

The data in Table 2 clearly show that incorporation of finely dispersed carbon particles of different types and with median particle sizes in the range of 0.070–0.22 microns leads to greatly improved laser marking of photographic elements relative to an clement that does not contain finely dispersed carbon particles. The greatest improvement in laser marking was seen in elements that contained finely dispersed carbon particles in which the median particle size was in the range of 0.070–0.16 microns.

The following structures represent compounds utilized in the above described photographic elements.

AFD-1

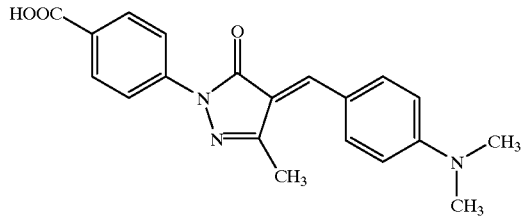

Antihalation filter dye

AFD-2

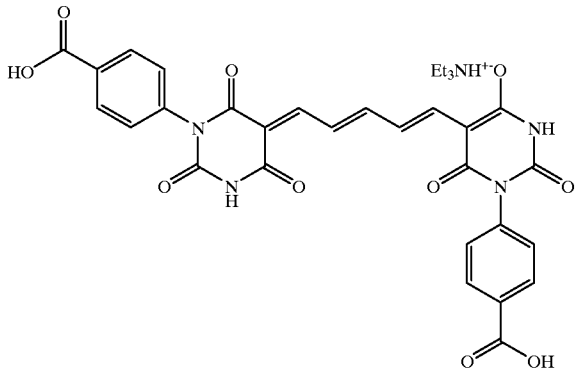

Antihalation filter dye

Y-1

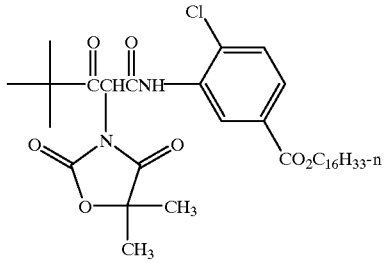

Yellow coupler

UV-1

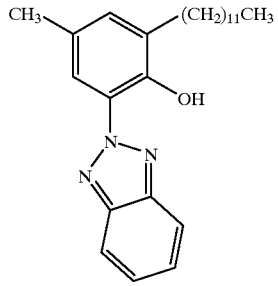

-continued
YPD-1
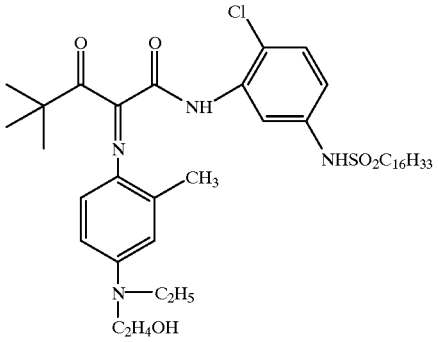
Yellow Preformed Dye
BFD-1
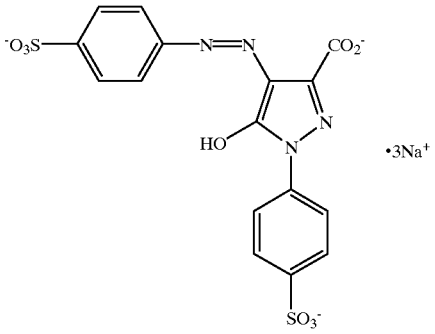
Blue filter dye
Scav-1
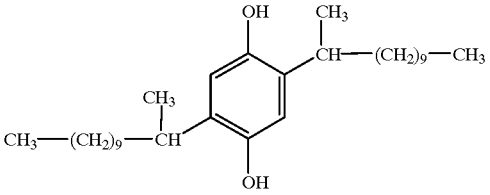
Scavenger
AF-1
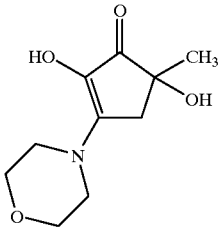
-continued
C-1
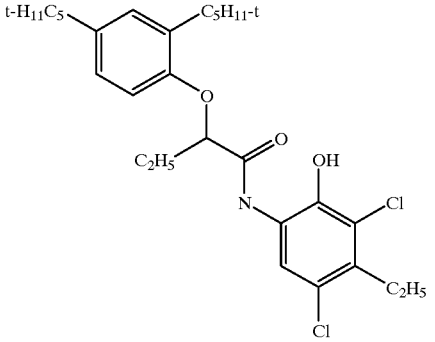
Cyan coupler
AF-2
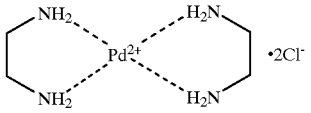
M-1
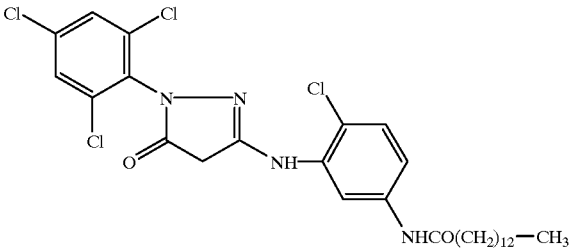
Magenta coupler
GFD-1
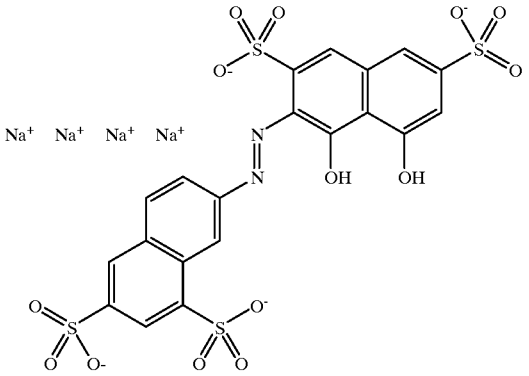
Green Filter Dye -continued

GFD-2

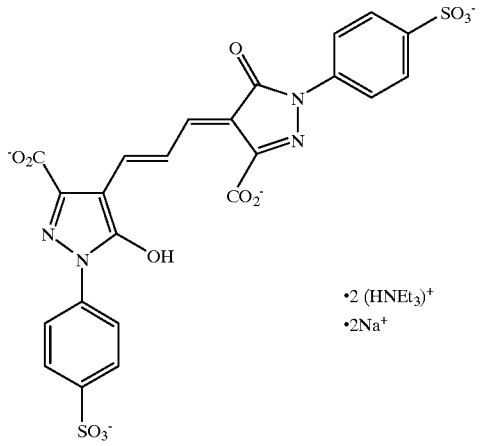

Green Filter Dye

A-1

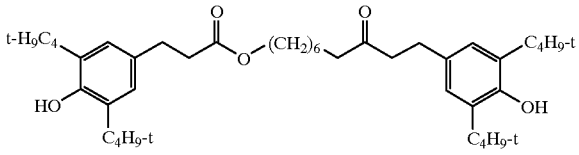

Antioxidant

While the invention has been described in detail with particular reference to preferred embodiments, it will be understood that variations and modifications can be effected within the spirit and scope of the invention.

What is claimed:

1. A motion picture photographic film element comprising a support having on a front side thereof a subbing layer unit and one or more image-forming units comprising at least one light-sensitive silver halide emulsion layer coated over the subbing layer unit, wherein the layers coated on the front side of the support comprise in total from 5 to 30 mg/m$^2$ of dispersed carbon particles, and the majority of the dispersed carbon particles is contained in the emulsion layer or layers of the one or more image-forming units or in intercoat layers which may be present between two emulsion layers.

2. A film element according to claim 1, wherein less than 5 mg/m$^2$ of dispersed carbon particles are present in layers on the front side of the support within 1 micrometer of the support surface.

3. A film element according to claim 1, wherein less than 5 mg/m$^2$ of dispersed carbon particles are present in layers coated over all the emulsion layers.

4. A film element according to claim 1, wherein the dispersed carbon particles have average dispersed particle size of less than 0.3 microns.

5. A film element according to claim 1, wherein the dispersed carbon particles have average dispersed particle size of less than 0.22 microns.

6. A film element according to claim 1, wherein the dispersed carbon particles have average dispersed particle size of less than 0.16 microns.

7. A film element according to claim 1, wherein the layers coated on the front side of the support comprise in total from 5 to 22 mg/m$^2$ of dispersed carbon particles.

8. A film element according to claim 1, wherein the layers coated on the front side of the support comprise in total from 5 to 20 mg/m$^2$ of dispersed carbon particles.

9. A film element according to claim 1, comprising yellow, magenta, and cyan dye image-forming units comprising light-sensitive silver halide emulsion layers coated over the subbing layer unit, wherein the majority of the dispersed carbon particles is contained in the emulsion layers of the yellow, magenta, and cyan dye image-forming units or in intercoat layers which may be present between two emulsion layers.

10. An element according to claim 9, wherein the subbing layer unit includes an antihalation undercoat between the support and the emulsion layers.

11. An element according to claim 1, wherein the subbing layer unit includes an antihalation undercoat between the support and the emulsion layer.

12. A color motion picture print film element comprising a support having on a front side thereof, in order, a yellow dye image-forming unit comprising at least one blue-sensitive silver halide emulsion layer having associated therewith at least one yellow dye-forming coupler, a first emulsion intercoat layer, a cyan dye image-forming unit comprising at least one red-sensitive silver halide emulsion layer having associated therewith at least one cyan dye-forming coupler, a second emulsion intercoat layer, and a magenta dye image-forming unit comprising at least one green-sensitive silver halide emulsion layer having associated therewith at least one magenta dye-forming coupler, wherein the layers coated on the front side of the support comprise in total from 5 to 30 mg/m$^2$ of dispersed carbon particles, and the majority of the dispersed carbon particles is contained in the emulsion layers and emulsion intercoat layers.

13. A film element according to claim 12, wherein the majority of the dispersed carbon particles are incorporated into the cyan dye image-forming unit and the first and second emulsion intercoat layers.

14. A film element according to claim 12, wherein less than 5 mg/m$^2$ of dispersed carbon particles are present in layers on the front side of the support within 1 micrometer of the support surface.

15. A film element according to claim 12, wherein less than 5 mg/m$^2$ of dispersed carbon particles are present in layers coated over all the emulsion layers.

16. A film element according to claim 12, wherein the dispersed carbon particles have average dispersed particle size of less than 0.22 microns.

17. A film element according to claim 12, wherein the dispersed carbon particles have average dispersed particle size of less than 0.16 microns.

18. A film clement according to claim 12, wherein the layers coated on the front side of the support comprise in total from 5 to 22 mg/m$^2$ of dispersed carbon particles.

19. A film element according to claim 12, wherein the layers coated on the front side of the support comprise in total from 5 to 20 mg/m$^2$ of dispersed carbon particles.

20. An element according to claim 12, wherein the subbing layer unit includes an antihalation undercoat between the support and the emulsion layer.

* * * * *